US011340033B2

(12) United States Patent
Hofleitner et al.

(10) Patent No.: US 11,340,033 B2
(45) **Date of Patent: *May 24, 2022**

(54) AUTHENTICATION AND UNLOCKING SYSTEM AND METHOD UTILIZING MAGNETIC ACTUATION

(71) Applicant: Pahmet LLC, Washington, DC (US)

(72) Inventors: Peter Hofleitner, Annapolis, MD (US); Martin Tross, Annapolis, MD (US)

(73) Assignee: Pahmet LLC, Washington, DC (US)

( * ) Notice: Subject to any disclaimer, the term of this patent is extended or adjusted under 35 U.S.C. 154(b) by 295 days.

This patent is subject to a terminal disclaimer.

(21) Appl. No.: 16/814,259

(22) Filed: Mar. 10, 2020

(65) Prior Publication Data

US 2020/0208932 A1 Jul. 2, 2020

Related U.S. Application Data

(63) Continuation of application No. 15/549,095, filed as application No. PCT/US2015/068203 on Dec. 30, 2015, now Pat. No. 10,627,178.

(Continued)

(51) Int. Cl.
*F41A 17/06* (2006.01)
*E05B 47/00* (2006.01)

(52) U.S. Cl.
CPC ..... *F41A 17/06* (2013.01); *E05B 47/004* (2013.01); *E05B 47/0038* (2013.01);

(Continued)

(58) Field of Classification Search
CPC ..... E05B 47/0038; E05B 47/0045; E05B 47/004; F41A 17/06; F41A 17/063; F41A 17/066

(Continued)

(56) References Cited

U.S. PATENT DOCUMENTS 3,395,555 A 8/1968 Henry
3,512,382 A 5/1970 Check et al.

(Continued)

FOREIGN PATENT DOCUMENTS

CN 102226373 A 10/2011
CN 102518339 A 6/2012

(Continued)

OTHER PUBLICATIONS

Internation Search Report for PCT Application No. PCT/US2015/068203 dated May 7, 2016.

(Continued)

*Primary Examiner* — Lloyd A Gall
(74) *Attorney, Agent, or Firm* — Rouget F. Henschel; Potomac Law Group, PLLC

(57) ABSTRACT

A magnetically actuated authentication and unlocking system is provided that is particularly suited for integration into a firearm, but that can also be incorporated into any device that requires an operator to hold a grip, handle or stick controller. The system includes a locking mechanism that is installed in a device and an unlocking mechanism that is preferably incorporated into wearable gear, such as a glove. The system utilizes magnets in the locking mechanism and unlocking mechanism, such that when a user wearing an unlock mechanism encoded with the correct magnetic "key" holds the device with the locking mechanism, the locking mechanism unlocks the device.

7 Claims, 18 Drawing Sheets

Related U.S. Application Data

(60) Provisional application No. 62/098,098, filed on Dec. 30, 2014.

(52) U.S. Cl.
CPC ..... *E05B 47/0045* (2013.01); *F41A 17/063* (2013.01); *F41A 17/066* (2013.01)

(58) Field of Classification Search
USPC ..... 70/276, 413
See application file for complete search history.

(56) References Cited

U.S. PATENT DOCUMENTS

| | | | |
|---|---|---|---|
| 3,571,544 | A | 3/1971 | Sheehan |
| 3,657,907 | A | 4/1972 | Boving |
| 3,782,147 | A | 1/1974 | Hallmann |
| 3,790,197 | A | 2/1974 | Parker |
| 5,062,232 | A | 11/1991 | Eppler |
| 5,651,206 | A | 7/1997 | Matarazzo |
| 5,758,524 | A | 6/1998 | Yu |
| 6,314,777 | B1 | 11/2001 | Allen |
| 6,351,906 | B1 | 3/2002 | Honig, Jr. et al. |
| 6,481,138 | B1 | 11/2002 | Roca et al. |
| 6,487,804 | B1 | 12/2002 | Petrella, Jr. |
| 8,850,670 | B2 | 10/2014 | Fiedler |
| 10,627,178 | B2 * | 4/2020 | Hofleitner ..... E05B 47/004 |

FOREIGN PATENT DOCUMENTS

| | | | |
|---|---|---|---|
| CN | 104033045 | A | 9/2014 |
| CN | 203851924 | U | 10/2014 |
| EP | 0822307 | A1 | 2/1998 |
| EP | 1300647 | A1 | 4/2003 |
| WO | 9405962 | A1 | 3/1994 |

OTHER PUBLICATIONS

Supplementary European Search Report issued in application No. 15876322 dated Oct. 24, 2018.

Written Opinion of the ISA for PCT Applcation No. PCT/US2015/068203 dated May 7, 2016.

* cited by examiner

AUTHENTICATION AND UNLOCKING SYSTEM AND METHOD UTILIZING MAGNETIC ACTUATION

CROSS-REFERENCE TO RELATED APPLICATIONS

This application is a continuation of U.S. patent application Ser. No. 15/549,095, filed Aug. 4, 2017, which is a U.S. national stage of International Application No. PCT/US2015/068203, filed Dec. 30, 2015, which claims priority to U.S. Provisional Application Ser. No. 62/098,098, filed Dec. 30, 2014, the entire disclosures of which are incorporated herein by reference.

FIELD OF THE INVENTION

The present invention relates to authentication and unlocking devices and, more particularly, to a magnetically actuated authentication and unlocking system.

BACKGROUND OF THE RELATED ART

Fast and reliable authentication of authorized firearm operators is an issue that current smart-gun technology has not sufficiently addressed. Bulky batteries, delicate electronic components, and often insufficient processing power greatly diminish the value of smart-gun technology for use in military applications, in law enforcement, and for personal self-defense.

SUMMARY OF THE INVENTION

An object of the invention is to solve at least the above problems and/or disadvantages and to provide at least the advantages described hereinafter.

Therefore, an object of the present invention is to provide an authentication and unlocking system.

Another object of the present invention is to provide an authentication and unlocking system that s magnetically actuated.

Another object of the present invention is to provide an authentication and unlocking system that can be incorporated into a device that is held by a user.

Another object of the present invention is to provide an authentication and unlocking system that can be incorporated into a firearm.

Another object of the present invention is to provide an unlocking mechanism that is adapted to be worn by a user.

Another object of the present invention is to provide an authentication and unlocking system that utilizes a magnetic key that is defined by the position and polarization of magnets in a locking mechanism.

Another object of the present invention is to provide a magnetically actuated locking mechanism that unlocks a device when a magnetic unlock mechanism comes within an unlocking range.

Another object of the present invention is to provide a glove that incorporates a magnetic unlocking mechanism.

Another object of the present invention is to provide a magnetically actuated locking mechanism that unlocks a device when the device is held by a user wearing a glove that incorporates a magnetic key.

Another embodiment of the invention provides an unlocking and locking system for a device, including a device component that is actuatable to lock and unlock the device; a locking mechanism positioned in the device and including a first support structure that includes an integration element that is adapted to mechanically engage the device component, and at least two magnetized regions that are supported at separate spaced apart locations in the first support structure; an unlocking mechanism including a second support structure including a wearable component adapted to be worn by a user, wherein the wearable component includes a respective magnetized region supported at separate spaced apart locations for each magnetized region in the first support structure; wherein the magnetized regions in the first and second support structures are adapted such that when the wearable component is within a predetermined distance from the first support structure a magnetic attractive or repulsive force moves the locking mechanism by a sufficient distance to actuate the device component; and wherein when a user holds the device while wearing the wearable component the respective magnetized regions in the wearable component align with the magnetized regions in the first support structure and generate the repulsive or attractive magnetic force that moves the locking mechanism.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Those skilled in the art will appreciate that the invention described herein is susceptible to variations and modifications other than those specifically described. The invention includes all such variations and modifications.

Each document, reference, patent application or patent cited herein is expressly incorporated by reference herein in its entirety, which means it should be read and considered by the reader as part of this text. That the document, reference, patent application or patent cited herein is not repeated herein is merely for reasons of conciseness.

Any manufacturer's instructions, descriptions, product specifications and product sheets for any products mentioned herein, or in any document incorporated by reference herein, are hereby incorporated herein by reference, and may be employed in the practice of the invention.

The present invention is not to be limited in scope by the specific embodiments described herein, which are intended to be exemplary embodiments. Functionally equivalent products and methods are clearly within the scope of the invention described herein.

Definitions for selected terms used herein may be provided and apply throughout. Unless otherwise defined, all other scientific and technical terms used herein have the same meaning as commonly understood to one of ordinary skill in the art to which the invention belongs.

The present invention addresses these shortcomings in present authentication and unlocking devices through the use of a magnetic authentication and unlocking mechanism that does not require electronic components or electrical power sources. The described mechanism is not limited to firearms, and can be used in any application that requires fast and reliable operator authentication in the absence of electronic components.

The present invention is directed to magnetically actuated authentication and unlocking system that utilizes a magnetic lock and unlock mechanism. The present invention is particularly suited for integration into a firearm, where it is used to engage and disengage the firearm's internal safety. Thus, for purposes of illustration, the present invention will be predominantly described in the context of a firearm. However, it should be appreciated that the present invention can be incorporated into any device that requires an operator to hold a grip, handle, or stick controller.

Figure 1A:
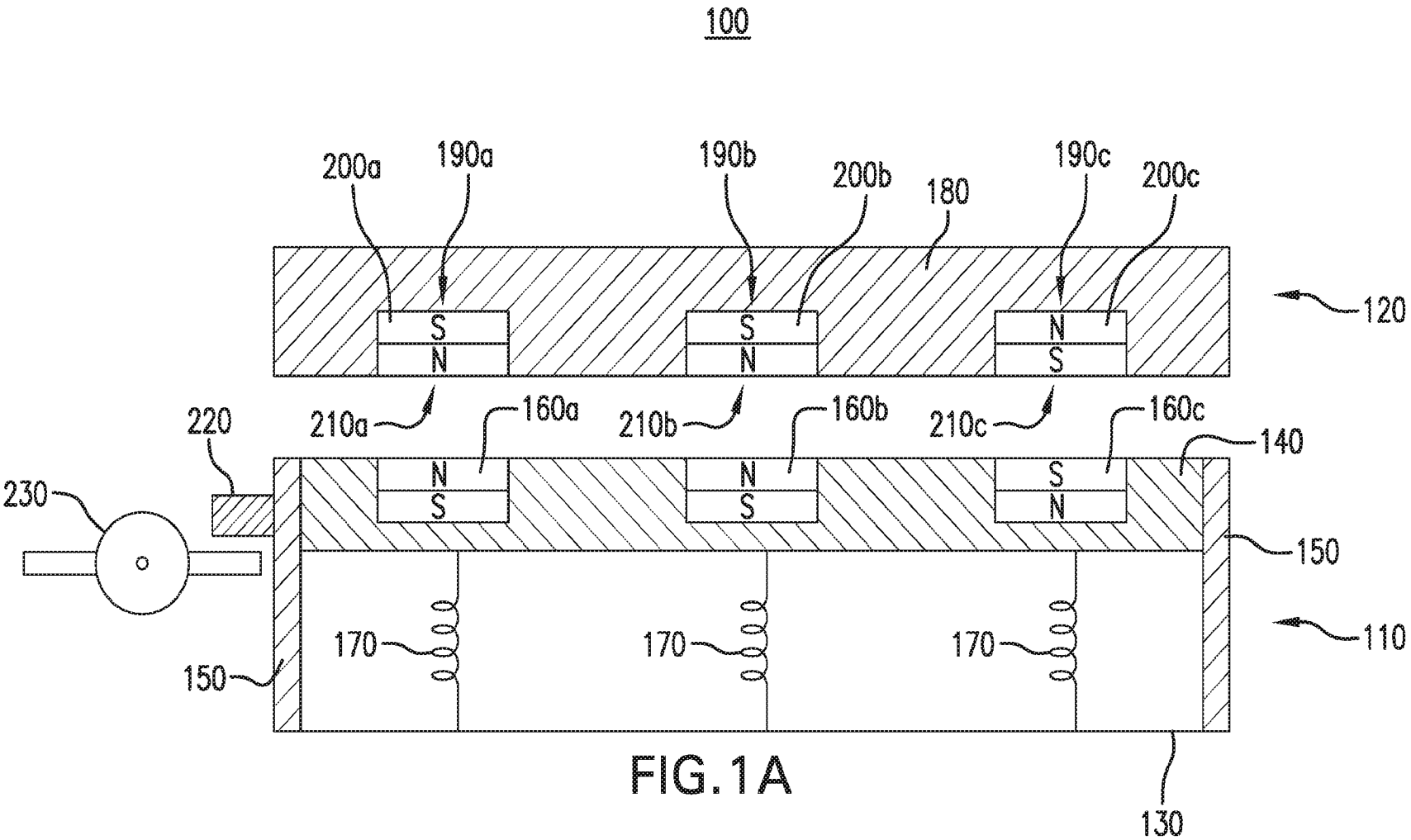
FIGS. 1A and 1B are cross sectional schematic views of a magnetically actuated authentication and unlocking system 100, in accordance with one embodiment of the present invention.
Figure 1B:
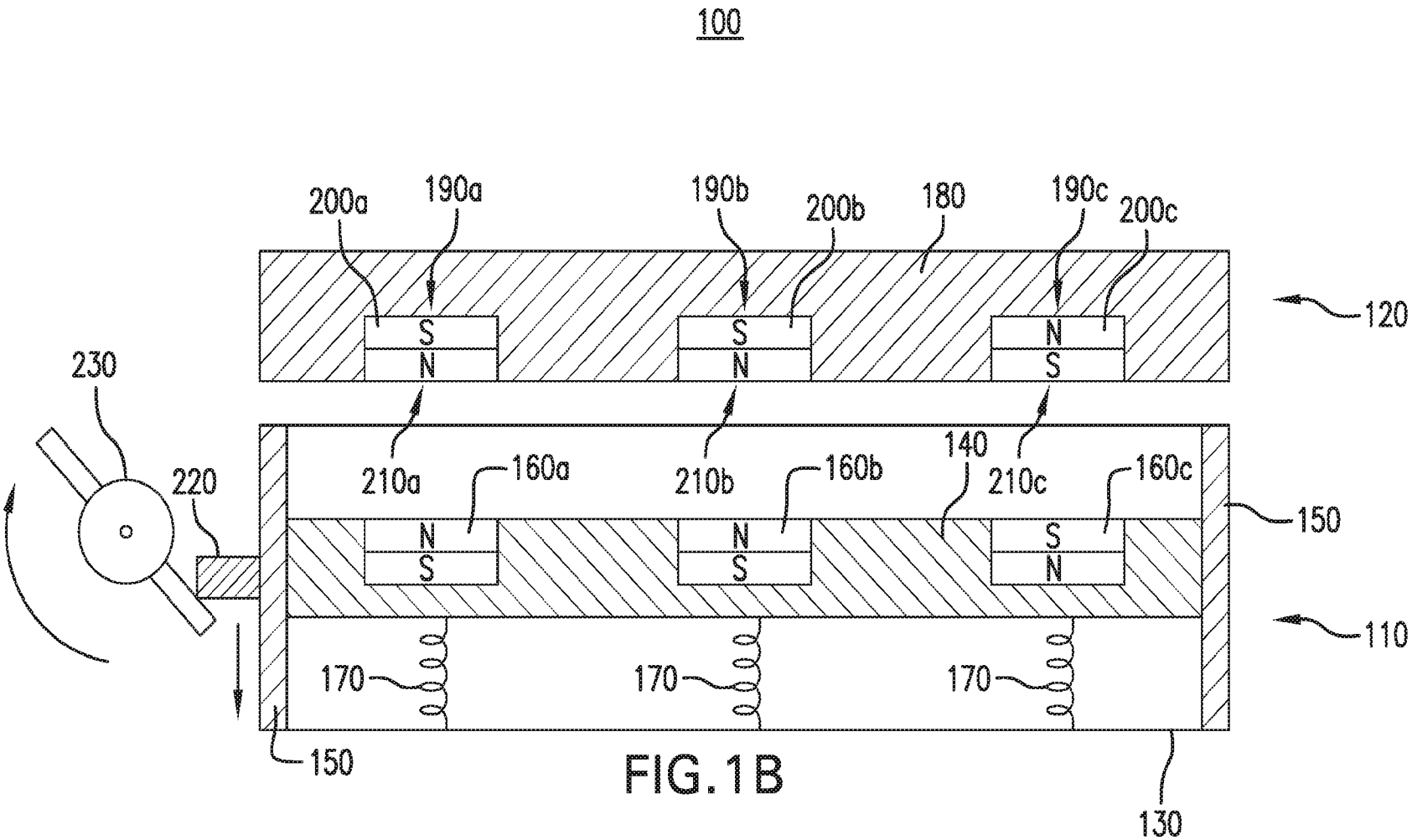

FIGS. 1A and 1B are cross-sectional schematic views of a magnetically actuated authentication and unlocking system 100, in accordance with one embodiment of the present invention. FIG. 1A shows the system 100 in a default locked configuration and FIG. 1B shows the system 100 in an unlocked configuration, as will be explained more detail below.

Figure 1C:
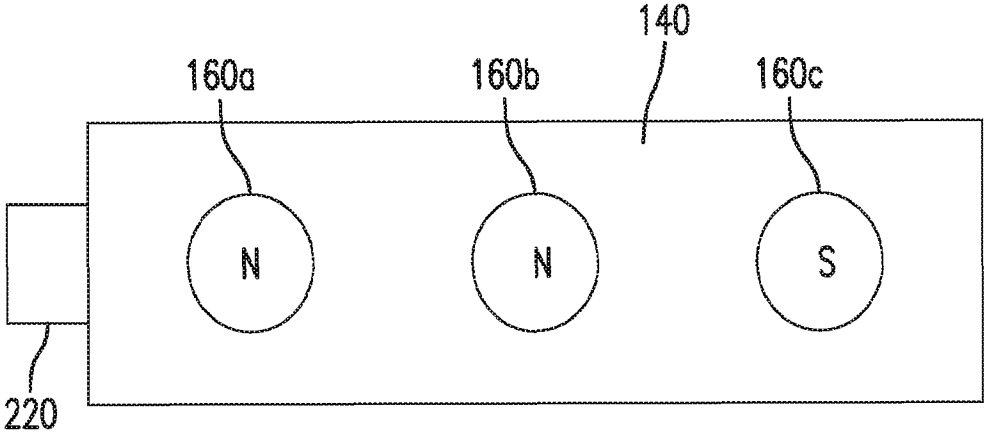
FIG. 1C is a top view of a plate with removable magnets used in the system of, in accordance with one embodiment of the present invention.

The system 100 includes a locking mechanism 110 and an unlocking mechanism 120. The locking mechanism preferably comprises a casing 130 that holds components of the locking mechanism 110. Those components preferably include a plate 140 mounted on guide rails 150 that hold one or more removable magnets 160*a*-160*c*, and one or more compliant members 170 that keep the plate 140 in a default locked position absent an external force. A top view of the plate 140 with the removable magnets 160*a*-160*c* is shown in FIG. 1C. An integration element 220 is attached to the plate 140, whose function will be described in more detail below.

The casing 130 is preferably made of a material that is resistant to shock, caustic liquids and temperature extremes, such as, for example Polymer 2. The preferred dimensions of the casing 130 are between 5 mm to 20 mm width, up to 10 mm height, and 50 mm to 70 mm length. Plate 140 is preferably made of Neodymium magnetic material mixed with a polymer binder. The preferred dimensions of the plate 140 are between 10 mm to 15 mm width, 1 mm to 3 mm height, and 45 mm to 65 mm length. The preferred dimensions of the magnets 160*a*-160*c* are 10 mm to 12 mm diameter and 1 mm to 3 mm height. The magnets 160*a*-160*c* are preferably insert-molded into the plate 140.

The unlocking mechanism 120 preferable comprises a wearable component 180 that contains one or more magnetized regions 190*a*-190*c*. The magnetized regions 190-*a*-190 can be implemented by magnetizing the material that makes up the wearable component at the appropriate locations, or by removable magnets 200*a*-200*c* positioned in inserts that are formed in the wearable component 180. The wearable component 180 is suitably a glove, but can be any type of wearable gear that can be magnetized or on which magnets 200*a*-200*c* can be removably attached or inserted.

The magnets 160*a*-160*c* and 200*a*-200*c* are labeled with the letters "N" and "S" to indicate the location of the magnets' north pole (N) and south pole (S). In the embodiment of FIGS. 1A and 1B, for each magnet 160*a*-160*c* mounted on plate 140 there are corresponding magnetic regions 190*a*-190*c* or magnets 200*a*-200*c* on the wearable component 180. The locations of magnets 200*a*-200*c* magnetic regions 190*a*-190*c* on wearable component 180 are referred to herein as "interface points" 210*a*-210*c*. The positions of magnets 160*a*-160*c* are such that when a user wearing the wearable component 180 grabs a device incorporating the locking mechanism 110, the interface points 210*a*-210*c* align with magnets 160*a*-160*c*.

In the embodiment of FIGS. 1A and 1B, the poles of magnets 160*a*-160*c* and corresponding magnetic regions/magnets 190*a*-190*c*/200*a*-200*c* are oriented such that they repel each other when the unlocking mechanism 120 is in close proximity to the locking mechanism 110 and magnets 160*a*-160*c* align with the face points 210*a*-210*c*. The strength of the magnet 160*a*-160*c* and magnetic regions 190*a*-190*c* or magnets 200*a*-200*c* are chosen such that when a user wearing the wearable component 180 grabs a device incorporating the locking mechanism 110, such that magnets 160*a*-160*c* align with the interface points 210*a*-210*c*, the repelling force generated by the magnets is sufficient to push the plate 140 inwards against the compliant members 170, as shown in FIG. 1B, when the distance between the locking and unlocking mechanisms 110/120 falls within an unlocking range. The phrase "unlocking range" the context of system 100 is defined as a distance between the unlocking mechanism 120 and locking mechanism 110 over which the magnetic repelling force created by the magnets and/or magnetic regions in the locking and unlocking mechanisms 110/120 is strong enough to push the plate 140 inwards against the compliant members 170.

When the plate 140 is pushed it compliance the members 170, an integration element 220 engages device component 230. Generally, integration component 220 is a component that engages the device in which the locking mechanism 110 is installed, via the device component 230, to change the device's operational state. In the context of a firearm, device component 230 can be a safety mechanism that engages and disengages the firearm's safety, and the in ion element 220 is suitably one or more pins or other objects attached to plate 140 that causes device component 230 to move when the plate 140 moves in response to the magnetic repelling force. In the context of a safety mechanism in a firearm, the position of the device component 230 shown in FIG. 1A corresponds to "safety on" (locked) and the position of the device component 230 shown in FIG. 1B corresponds to "safety off" (unlocked). In other applications of the present invention, which will be discussed below, the implementation of device component 230 and integration component 220 will depend on the type of device in which the locking mechanism 110 is installed.

The number of magnets and/or magnetic regions 200/190 used in the unlocking mechanism 120, their position, and their polarity (North/South) can together be characterized as a "key." In system 100, the key used by the unlocking mechanism 120 is referred to as an "unlock key" if the poles of each of the magnets 160*a*-160*c* in the locking mechanism 110 and each counterpart magnetic regions 190*a*-190*c*/200*a*-200*c* in the unlocking mechanism 120 are oriented such that they repel each other when the unlocking mechanism 120 is in close proximity to the locking mechanism 110 and magnets 160*a* 160*c* in the locking mechanism 110 align with the interface points 210*a*-210*c*. This is because the compliant members are chosen such that the repelling force from all three magnet pairs (e.g., 200*a*/160*a*, 200*b*/160*b*, 200*c*/160*c*) is needed to move the plate 140 by a sufficient amount to move the device component 230 to the unlocked position.

The compliant members 170 are suitably implemented with springs, in which case the spring constants of the springs are chosen so that the repelling force from all three magnet pairs (e.g., 200*a*/160*a*, 200*b*/160*b*, 200*c*/160*c*) is needed to move the plate 140 by a sufficient amount to move the device comp 230 to the unlocked position. Thus, only an unlocking mechanism 120 with the unlock key (i.e., the same number of magnets or magnetic regions 200/190, with the same polarity as the corresponding magnets in the locking mechanism 110 and aligned with the interface points) can move the plate 140 by a sufficient amount to engage the device cot emit 230.

For example, one or more magnets and/or magnetic regions in the unlocking mechanism 120 were oriented in the same direction as the corresponding magnet in the locking mechanism 110 (e.g., magnet 200*b* is oriented such that the south pole is facing magnet 160*b*), then the attractive force between magnets 200*b* and 160*b* would prohibit plate 140 from moving all the way to the unlocked position, because the other two magnet pairs that are oriented in a repelling configuration (200*a*/160*a* and 200*c*/160*c*) would not generate a large enough repelling force to move the plate 140 by a sufficient amount to engage the device component 230. In addition, the guide rails 150 are preferably adapted to keep the plate 140 from tilting. This will further prevent the plate 140 from moving downwards unless the unlock key is used in the unlocking mechanism 120.

Figure 1E:
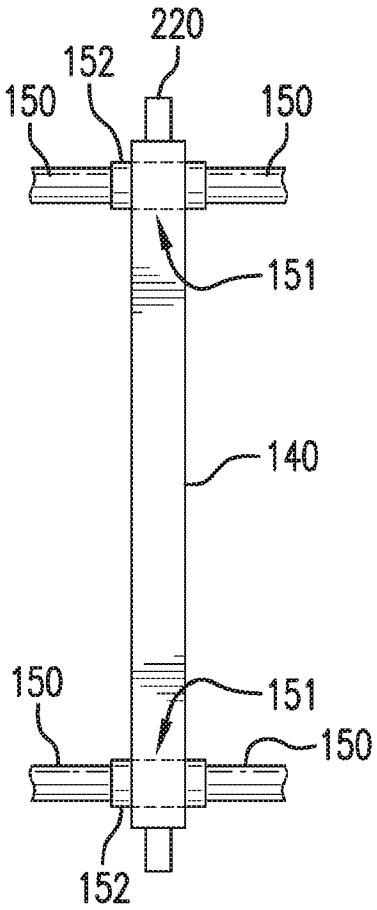
FIGS. 1D and 1E are perspective anti side views, respectively, illustrating how plate 140 is mounted on guides 150, in accordance with one embodiment of the present invention.
Figure 1D:
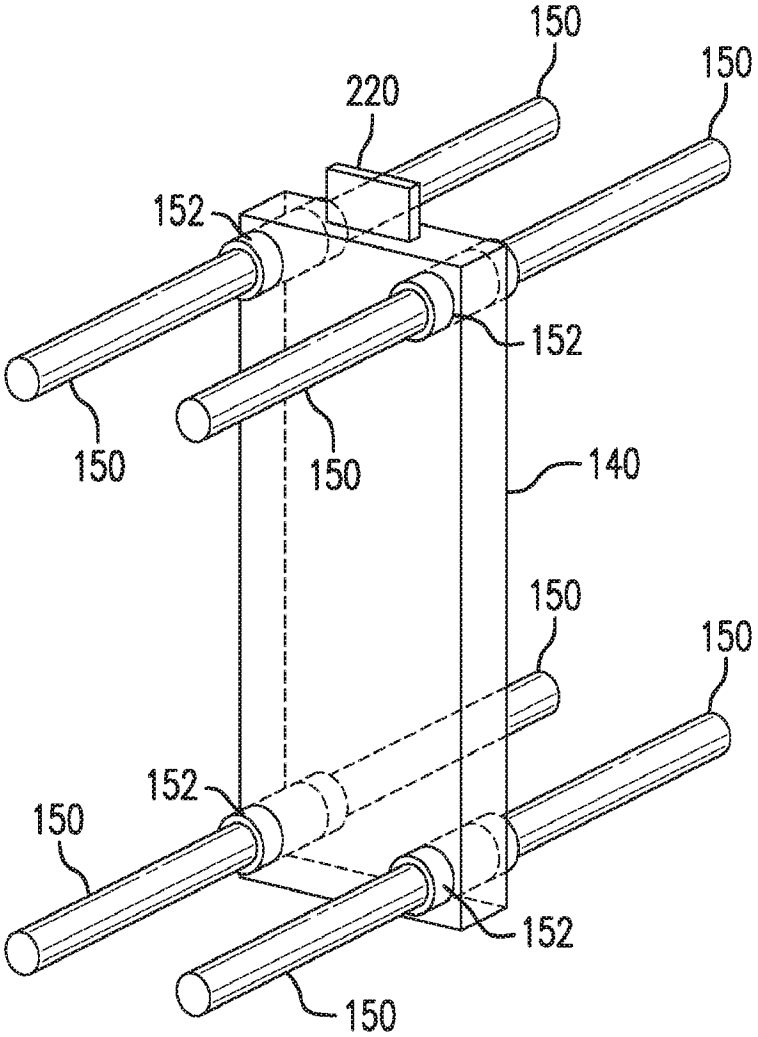

FIGS. 1D and 1E are perspective and side views, respectively, of the plate 140 and guide rails 150, illustrating how the guide rails 150 and plate 140 can be adapted to keep the plate 140 from substantially tilting, in accordance with one embodiment of the present invention. The guide rails 150 preferably extend through holes 151 formed in each of the four corners of the plate 140. In a preferred embodiment, sleeves 152 that are longer then the width of the plate 140 are inserted into each hole 151, and the guide rails 150 extend through the sleeves 152. This provides additional stability to the plate 140 when an asymmetric force is applied to the plate 140.

Figure 2A:
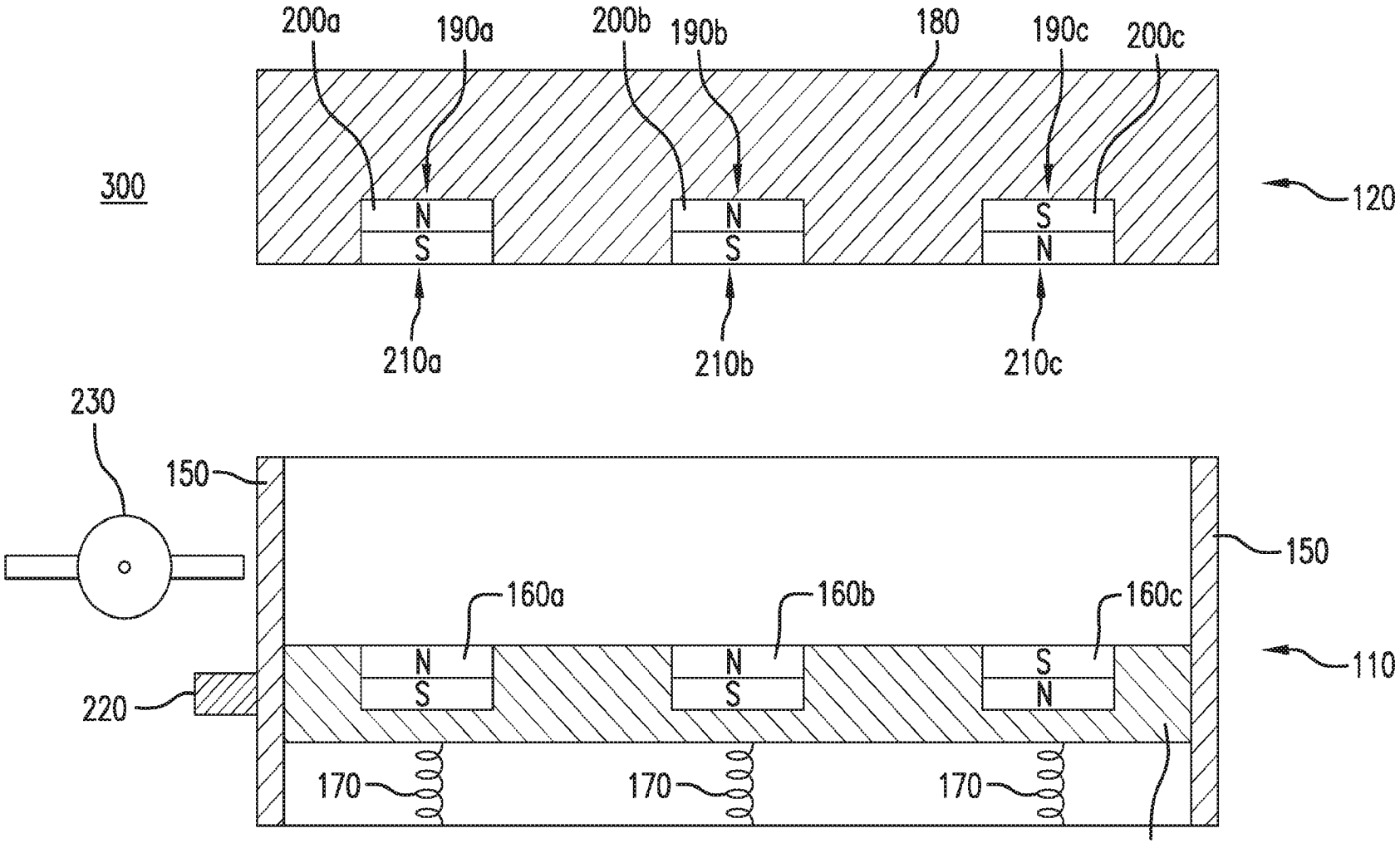
FIGS. 2A and 2B are cross-sectional schematic views of a magnetically actuated authentication and unlocking system 100, in accordance with another embodiment of the present invention.
Figure 2B:
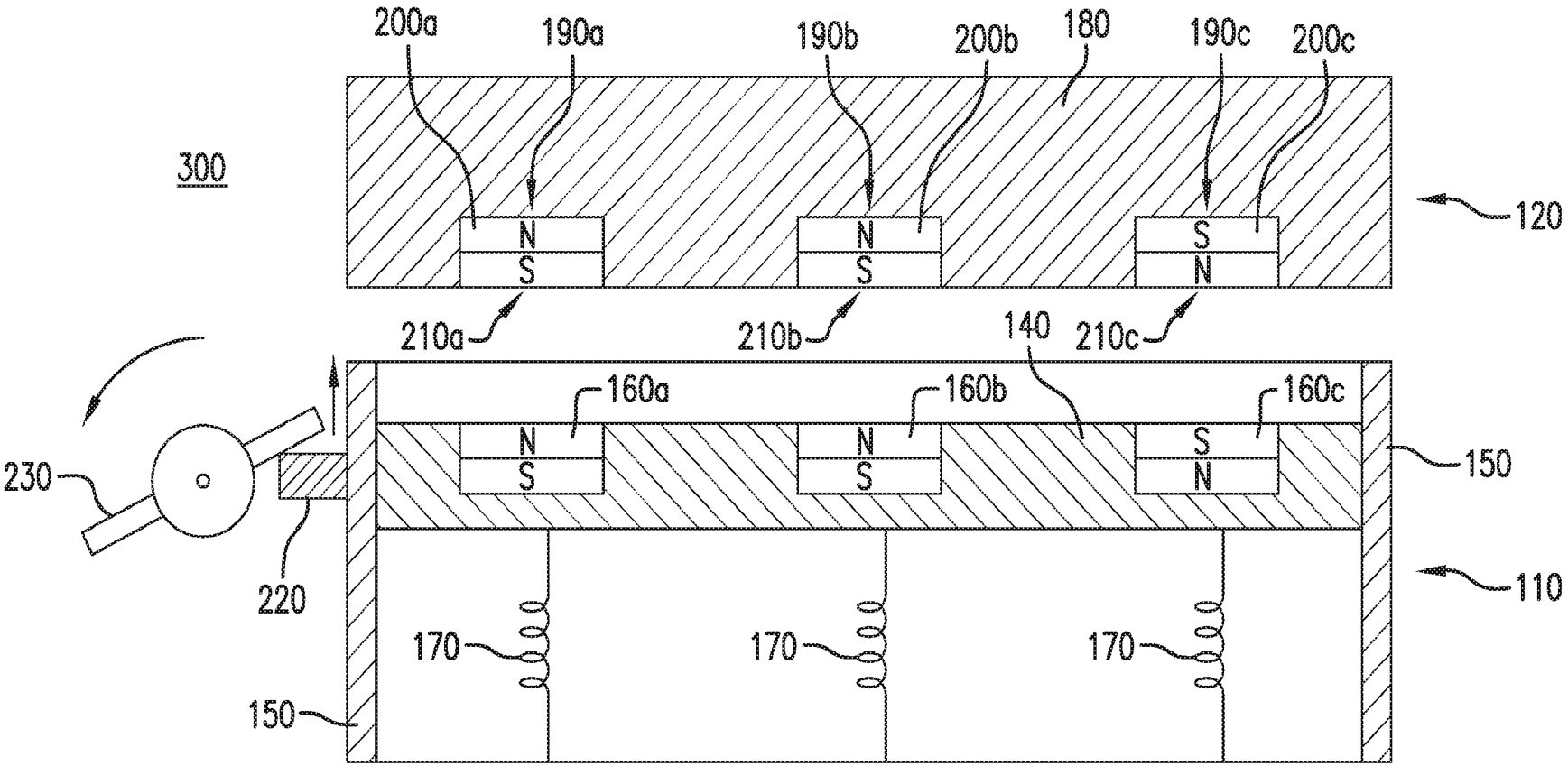

The system 100 shown in FIGS. 1A-1C is designed to use a magnetic repelling force to move the plate 140 down to engage the device component. FIGS. 2A and 2B are cross sectional schematic views of a magnetically actuated authentication and unlocking system 300 which utilizes magnetic attraction to move the plate 140, in accordance with another embodiment of the present invention. The principle of on of system 300 is generally the same as that of system 100, except that system. 300 is adapted to use magnetic attraction instead of magnetic repulsion.

Thus, in system 300 the unlock key for the unlocking mechanism 120 corresponds to pole orientations for of each of the magnets 200*a*-200*c* and/or magnetic regions 190*a*-190*c* that are opposite to the pole orientations of the counterpart magnets 160*a*-160*c* in the locking mechanism 110. With this unlock key, each of the magnets in the unlocking mechanism 120 will attract the counterpart magnet in the locking mechanism 110 when the unlocking mechanism 120 is within the unlocking range and magnets 160*a*-160*c* are aligned with the interface points 210*a*-210*c*. In system 300, the unlocking grange is defined as a distance between the unlocking mechanism 120 and locking mechanism 110 over which the magnetic attractive force created by the magnets and/or magnetic regions in the locking and unlocking mechanisms 110/120 is strong enough to pull the plate 140 by an amount sufficient to engage the device component 230 and move the device component 230 to an unlocked position (shown in FIG. 2B).

The compliant members 170 are chosen such that the attractive force from all three magnet pairs (e.g., 200*a*/160*a*, 200*b*/160*b*, 200*c*/160*c*) is needed to pull the plate 140 upwards by a sufficient amount to move the device component 230 to the unlocked position. The compliant members 170 are suitably implemented with springs, in which case the spring constants of the springs are chosen so that the attractive force from all three magnet pairs (e.g., 200*a*/160*a*, 200*b*/160*b*, 200*c*/160*c*) is needed to move the plate 140 by a sufficient amount to move the device component 230 to the unlocked position. Thus, like system 100, only an unlocking mechanism 120 with the unlock key (in this case, the same number of magnets or magnetic regions 200/190, with the opposite polarity as the corresponding magnets in the locking mechanism 110 and with magnets 160*a*-160*c* aligned with the interface points 210*a*-210*c*) can move the plate 140 by a sufficient amount to engage the device component 230.

Additional Locking/Unlocking Mechanism Embodiments Permanent-Lock Mechanism

With this embodiment, one or more invalid key combinations will permanently lock the locking mechanism 110.

To release the permanent lock, the locking mechanism 110 has to be removed from the device in which it is installed and reset. Removing, resetting, and reinstalling the unlock mechanism 110 requires special tools and knowledge of the specific unlock mechanism configuration. This procedure protects against unauthorized use by persons who do not have the proper tools and knowledge (e.g., a child playing with a gun that incorporates the present invention trying various combinations of magnets to unlock the locking mechanism 110 has a higher chance of permanently locking the locking mechanism 110 than unlocking it and firing the gun). This embodiment can be implemented by putting perm-locks at interface points where an invalid magnetic polarization will cause the perm-lock to permanently lock the device.

Figure 2C:
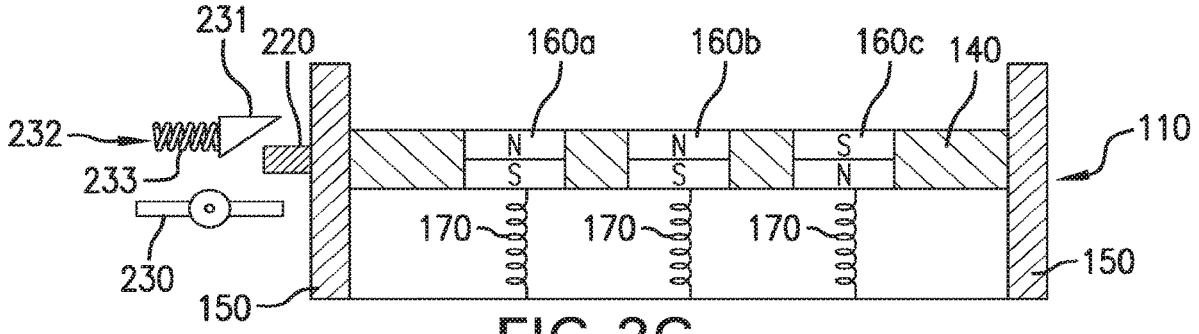
FIGS. 2C-2G are cross-sectional schematic views of a magnetically actuated authentication and unlocking system 100 that utilizes a permanent lock mechanism, in accordance with additional embodiments of the present invention.
Figure 2D:
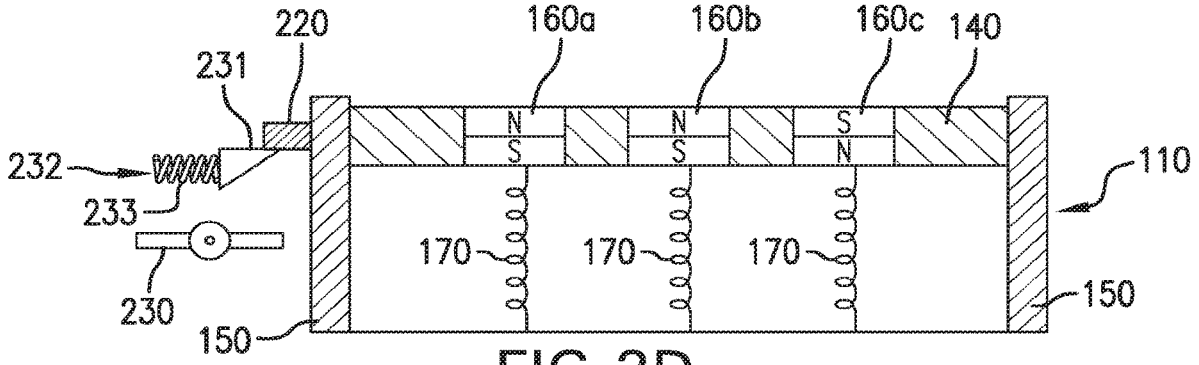

Such a perm lock can be suitably implemented with a compression spring catch 231 mounted behind the integration element 220 (in the outward direction of travel). Without any magnetic force applied, the plate 140 is in a resting position with the integration element 220 in front of the spring catch 231, as shown in FIG. 2C. When the exact inverse key combination is applied, the attracting force of the magnets 210*a*-210*c* (not shown in FIGS. 2C and 2D) and 160*a*-160*c* moves the plate 140 outward and the integration element 220 travels past the spring catch 231, as shown in FIG. 2D. At this point, the spring catch 231 locks the plate 140 in place by blocking the integration element 220 from moving inward. This prohibits inward movement of the plate 140 when the repulsive force of a matching magnetic key s applied.

To unlock the mechanism, the spring catch 231 has to be moved back mechanically to allow the plate 140 to move to its resting position. The spring catch 231 can be mounted on a type of flexible material 232 that allows the catch 231 to be pushed back when the integration on element 220 travels outwards and locks behind it. In the embodiment of FIGS. 2C and 2D, the flexible material 232 is a spring 233.

Figure 2E:
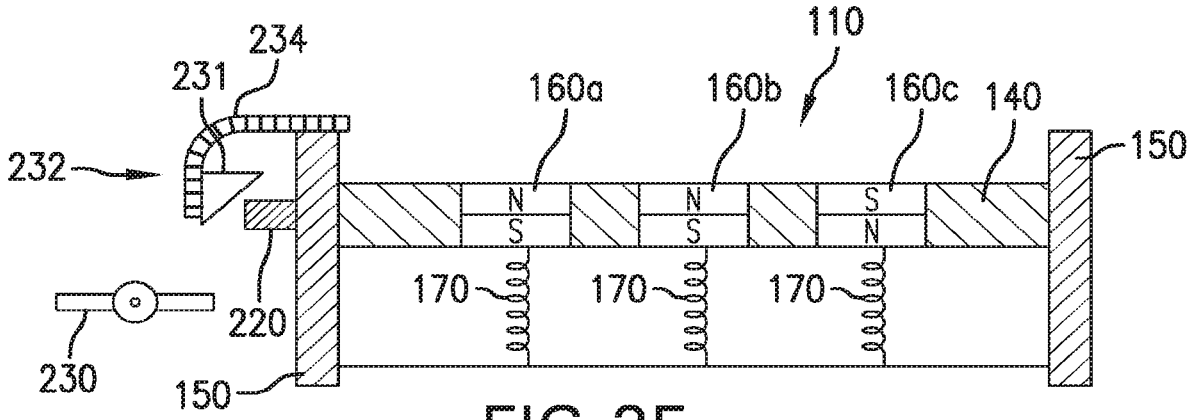
Figure 2F:
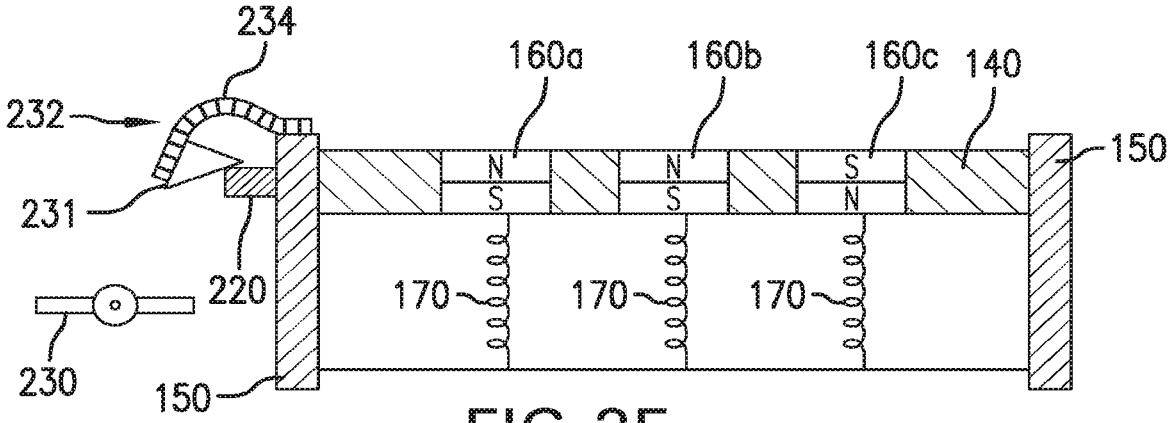
Figure 2G:
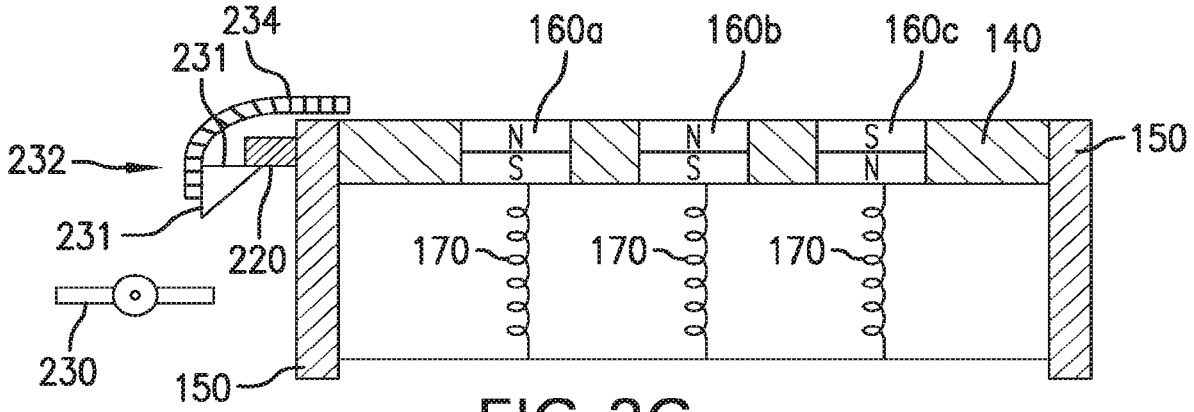

FIGS. 2E-2G shows an embodiment in which the flexible material 232 is a bent metal plate 234. FIG. 2E shows plate 140 in its resting position. FIG. 2F shows plate 140 in an intermediate position as it is being moved outwardly by the attracting force of the magnets 210*a*-210*c* (not shown in FIGS. 2E-2G). FIG. 2G shows the plate 140 in a locked position once the integration element 220 has moved past the spring catch 231.

Relaxed-Grip Mechanism

Once the locking mechanism 110 is unlocked, this embodiment would allow one or more magnets in the unlocking mechanism 120 to move beyond the unlocking range while maintaining the locking mechanism's 110 unlocked mode. A shooter in a firefight using a gun that incorporates the present invention may not be able to maintain a perfect grip on the gun at all the times. This embodiment allows the shooter to relax the grip without inadvertently putting the gun back in safe mode.

Another application of this embodiment is use as a kill-switch. An operator holding a grip for a long time may want to change the grip periodically. This embodiment allows loosening the grip, as long as at least one pair of matching magnets remains within the unlocking range. This embodiment can be implemented by putting push-locks at interface points where a solid grip needs to be maintained and putting locks at interface points where the grip can be relaxed. Since locks only prevent the device from unlocking but have otherwise no effect, an operator can relax the grip at interface points that contain locks once a device is unlocked. If the operator releases the grip on any interface point that has a push-lock then the device will lock again because the push-lock pushes the integration element hack to the default locked position.

Figure 2H:
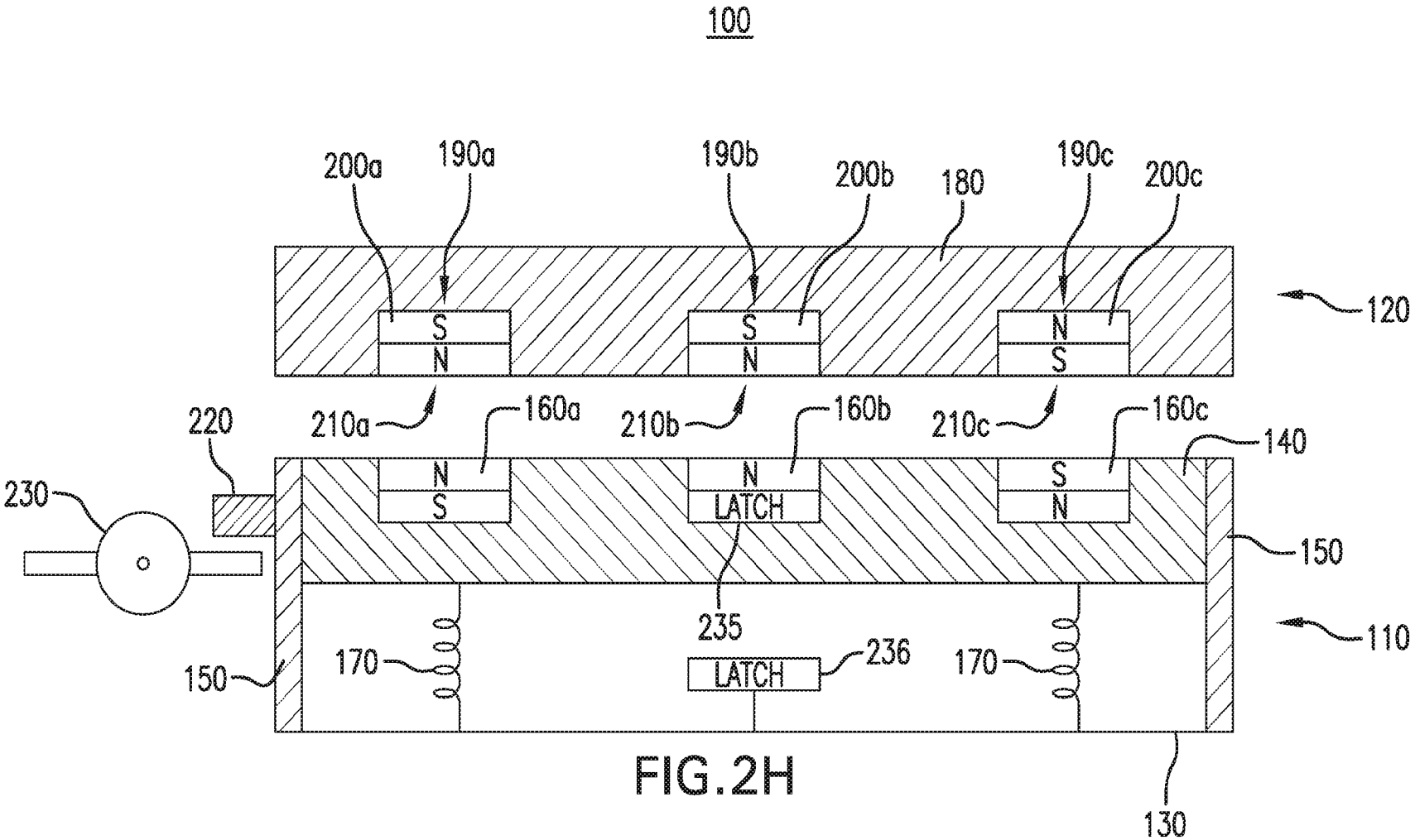
FIG. 2H is a cross-sectional schematic view of a magnetically actuated authentication and unlocking system 100 that utilizes a relaxed grip mechanism, in accordance with another embodiment of the present invention.
Figure 2I:
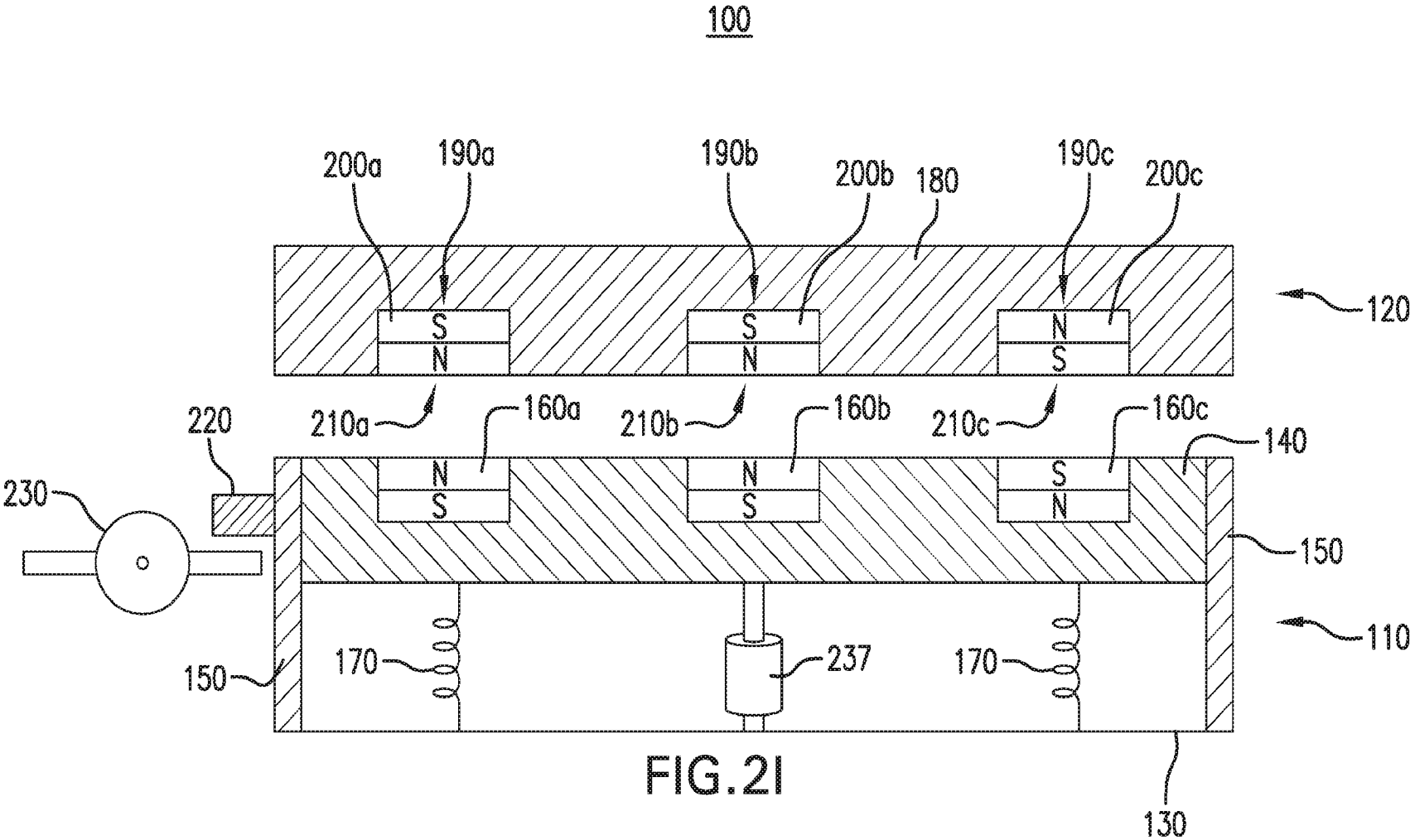
FIG. 2I is a cross-sectional schematic view of a magnetically actuated authentication and unlocking system 100 that utilizes a delayed lock mechanism, in accordance with another embodiment of the present invention.

A relaxed grip mechanism can be implemented by replacing one of the springs with a latch magnet pair. Latch magnet pairs are well known in the art, and provide a repulsive force when the magnets are at a distance and then an attractive force when the magnets are forced past their repelling state. FIG. 2I shows one embodiment of a relaxed grip mechanism based on the system 100 of FIGS. 1A-1C which utilizes a magnetic repelling force to move the device component 230 to an unlocked position. In the embodiment of FIG. 2H, the underside of one of one of the magnets in the locking mechanism 110 is implemented as one magnet 235 of a latch magnet pair and an posing second magnet 236 of the latch magnet pair is placed directly across from magnet 235. Latch magnet pair 235 and 236 replace spring 170 that would normally be attached to the underside of magnet 160*b*.

When the device is held the combined force of all magnets in the locking and unlocking mechanisms 110/120 is strong enough to overcome the opposing forces of the springs 170 and the latch magnet pair 235/236. At a certain distance between the locking mechanism 110 and unlocking mechanism 120 (within the distance required to maintain plate 140 in an unlocked position) the latch magnet pair 235/236 attract each other.

The attractive force of the latch magnet pair 235/236 cannot be stronger than the combined magnetic forces of the predetermined magnets in the wearable device that are allowed to be out of range while maintaining the plate 140 in an unlocked position. For example, if the attractive force of the latch magnet pair 235/236 equals the combined force of two magnets in the system 100, then two magnets in the system 100 can be out of range. When all magnets are out of range the combined forces of the mechanical springs 170 are stronger than the attractive force of the latch magnet pair 235/236 and push the plate 140 back into the locked position.

Delayed-Lock Embodiment

This embodiment does not lock the device immediately once the grip is released and the distance between all the opposing magnets are outside the unlocking range. Instead, the device locks after a predetermined delay. In a typical configuration, the delay is preferably from 1 to 5 seconds, but shorter or longer delays are also possible. The delay can be implemented through a slow moving piston or a motor or any other mechanical, magnetic, electromagnetic, or electric timer element that achieves a similar effect. The timer element can be mounted to the integration element 220 and slow its movement into the locked position, or it could be attached to a lock, slowing the movement of the lock, or it could be attached to on or more other elements in the device to achieve the desired delay.

A delayed lock can be suitably implemented by replacing one or more springs 170 with a pull damper or a push damper. In the embodiment where compressing the springs 170 moves the plate 140 to the locked position, a pull damper 237 is used, as shown in the embodiment of FIG. 2I, which is based on the system 100 of FIGS. 1A-1C. In the embodiment 300 where extending (stretching) the springs 170 moves the plate 140 to the locked position, a push per is used. The one-way damper (either pull or push) allows rapid movement of the plate 140 to the unlocked position, but damped (delayed) movement of the plate 140 to the locked position.

Interchangeable and Dummy Locking Mechanism

Devices (e.g., guns, rifles, or any other device with a grip or handle) can be designed to use locking mechanisms 110 that are interchangeable. For example, a SWAT team may decide to use the delayed-lock embodiment on all sidearms and the relaxed-grip embodiment for rifles before going into a specific situation. During preparation, they can swap out the locking mechanisms 110 in the devices with the ones they want to use.

In addition, a dummy locking mechanism can be used to put a device permanently in unlock mode, allowing operation without requiring an unlock key. For instance, when a dummy locking mechanism is used a gun, then the gun can be fired by any operator.

The interchangeability of locking mechanisms 110 also allows for use of different unlock keys depending situational requirements. A law enforcement officer who is on patrol may to use a personal unlock key so that only he can use his firearms and other equipment. If the officer is out with a partner of on a team, then the partners or team could use a team unlock key, allowing shared use of firearms and equipment.

Magnets/Magnetic Regions

The magnets and/or magnetic regions used in the locking mechanism 110 and unlocking mechanism 120 can be of any size and shape. The types of magnets that can be used in the locking and unlocking mechanisms 110/120 includes but are not limited to permanent magnet, electromagnet, electret, magnetized ferromagnetic material or portion thereof, superconductive magnetic material, soft magnetic material or any other type of magnet.

The types of materials that can be used for the magnets in the locking and unlocking mechanisms 110/120 include, but are not limited to sintered NdFeB (Neodymium Iron Boron), bonded NdFeB (Neodymium Iron Boron), SmCo (Samarium Cobalt), AlNiCo (Aluminum Nickel Cobalt), ceramic (Ferrite), rubberized magnets, wearable material (e.g., magnetizable cloth or material interwoven with cloth) or any other type of material.

The possible shapes of the magnets that can be used in the locking and unlocking mechanisms 110/120 include, but are not limited to disc, rod, plate, block, sphere, ring, tube, cloth in any shape or any other shape.

The possible types of magnetization for the magnets that can be used in the locking and unlocking mechanisms 110/120 include, but are not limited to magnetized, diametrically magnetized, radially magnetized, magnetized through the length, magnetized through the width, magnetized through the thickness or at other type of magnetization.

Because each magnet has two possible pole orientations (North or South), the number of possible keys available for use in systems 100 and 300 can be calculated as $2^m$, where "m" is the number of magnets in the locking and unlocking mechanisms 110/120. For example, a system 100 that uses 3 magnets and/or magnetic regions in the locking and unlocking mechanisms 110/120 (such as the one shown FIGS. 1A and 1B) can encode eight keys ($2^3$=8) system 100 that uses 4 magnets can encode 16 keys ($2^4$=16) and a system 100 that uses 5 magnets can encode 32 keys ($2^5$=32).

Compliant Members

Figure 3:
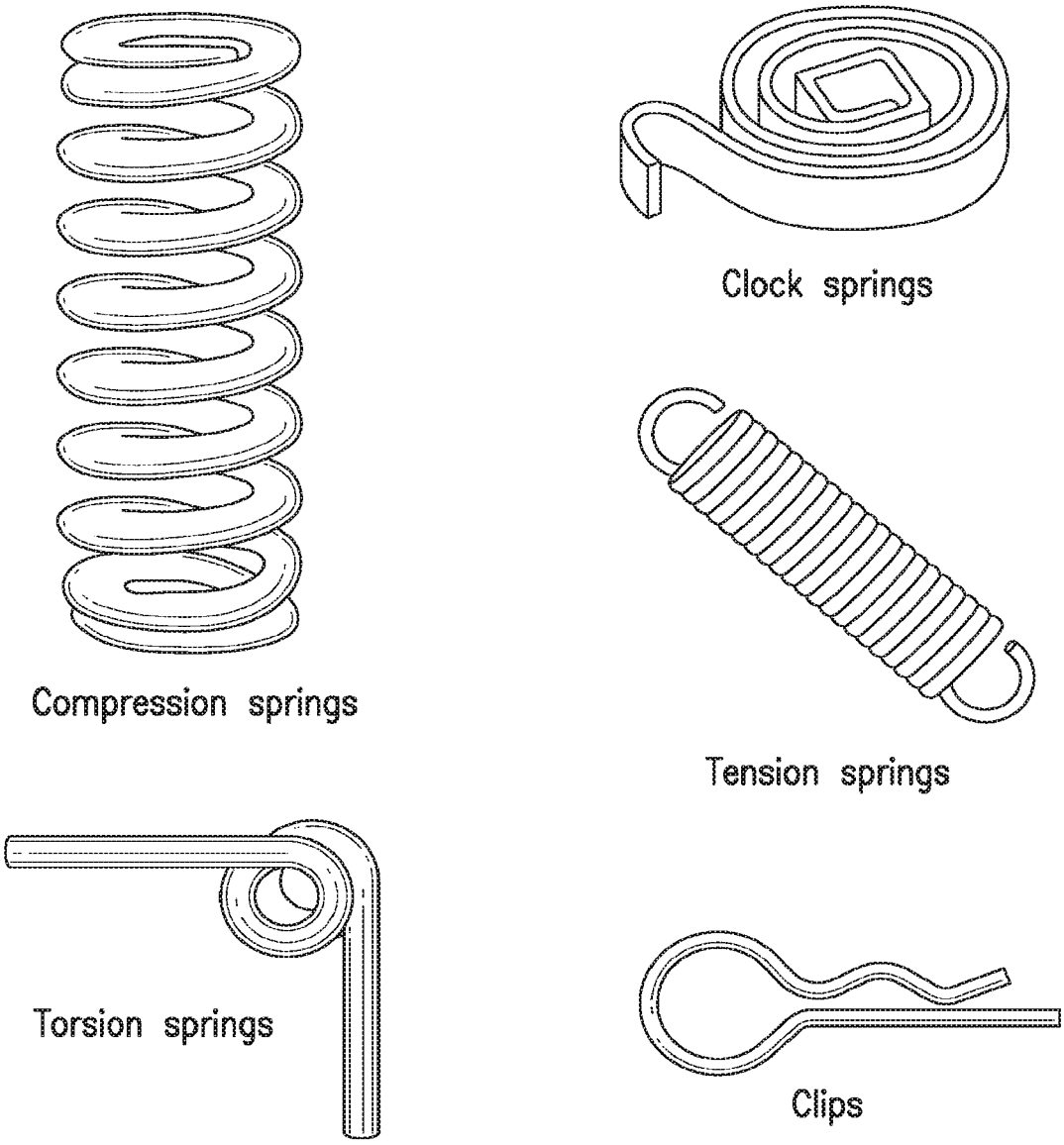
FIG. 3 is a perspective view of mechanical springs that can be used as compliant members, in accordance with one embodiment of the present invention.

The compliant members 170 are preferably implemented with springs. The types of springs that can be used include, but are not limited to mechanical springs, gas/hydraulic sprigs and magnetic springs. A mechanical spring can be of any material or shape that allows the spring to perform the desired function. Mechanical springs that can be used in the present invention include, but are not limited to compression springs, clock springs, tension springs, torsion springs, clips, Belleville washers or any other type of mechanical spring. FIG. 3 illustrates some examples of mechanical springs that can be used as compliant members 170.

Gas/hydraulic springs that can be used include, but are not limited to gas of hydraulic spring without dampener and gas or hydraulic spring with dampener. A magnetic spring can be of any type, material, shape, or magnetization listed above, or any other type, material, shape, or magnetization in any combination with other materials or components that allow the spring to perform the desired function.

Wearable Components

Figure 4:
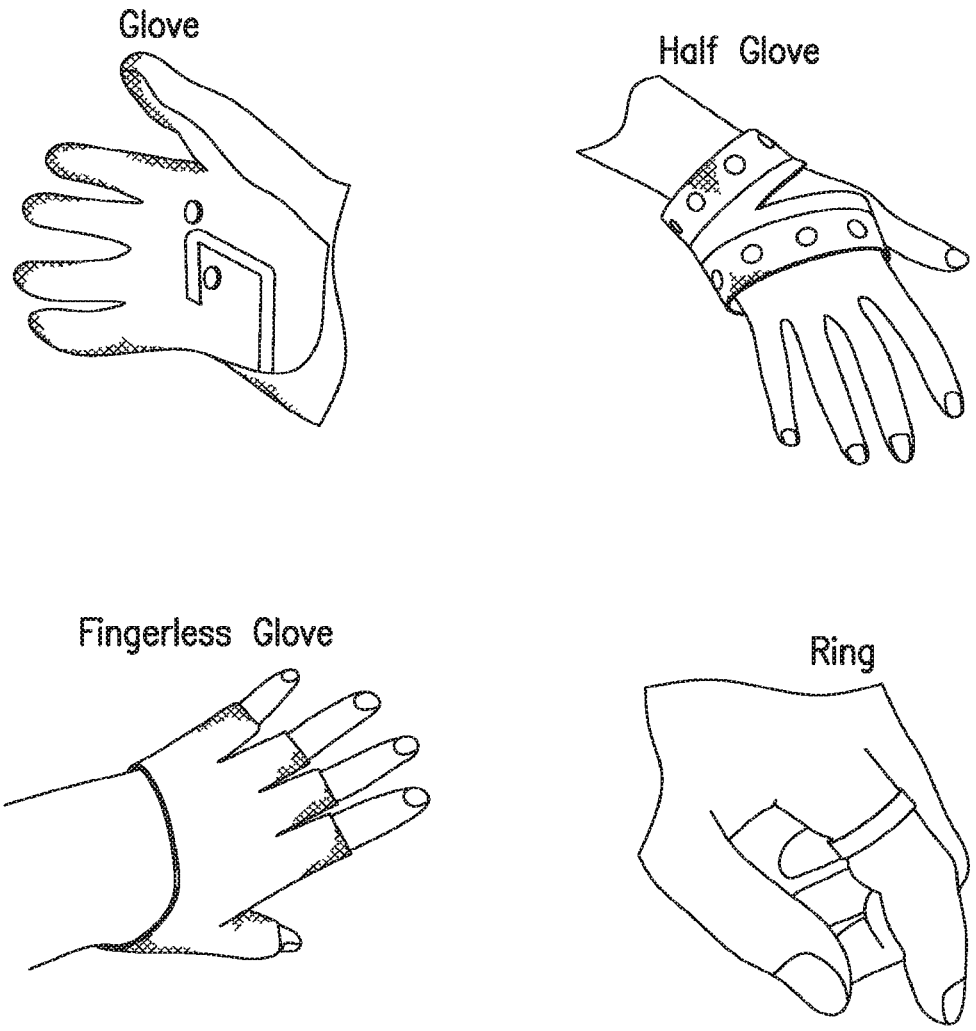
FIG. 4 is a perspective view of wearable components that can be used as for the unlocking mechanism, in accordance with one embodiment of the present invention.

Different types of wearable components 180 can be used to hold the magnetic regions 190 or magnets 200 that are arranged to form the unlock key including, but not limited to, rings, glove gloves, fingerless gloves or any other of gear that is worn on a finger, hand around the palms or other parts of the body. FIG. 4 illustrates examples of components that can be used in the unlocking mechanism 120.

Wearable components 180 can also be combined. For example, rings can be used together with gloves to offer interface points 210 on opposing sides of a grip that contains the locking mechanism 110. Interface points can be placed at different locations in or on wearable component 180. A glove can, for example, have interface points in the palm, the thumb, and one or more other fingers. This allows for a variety of implementations to: (a) meet specific grip requirements; (b) enrich the range of available keys through addition of interface points 210; and/or (c) offer customization through placement of interface points at specific locations.

Electrical contact points can be incorporated into the wearable component 180 that are connected to a wearable power source that the operator wears for feeding electrical power to a device that incorporates the locking mechanism 110 as soon as the operator holds the device. This could charge a battery in the device or even power up electric, electromagnetic, or electronic components within the device without requiring a separate power source within the device. Since batteries pose a problem to handguns due to their size, weight, and limited capacity, an external power source that feeds electricity to a device through a wearable component, such as a glove, may be advantageous for smart guns or any type of equipment that is held by an operator and requires power to operate.

The connection between the wearable component 180 and the wearable power source can be facilitated through conducting materials or power cords woven into or attached to clothing or body armor. The wearable component 180 could be pre-wired or made from (or integrated with) conductive material to allow for the flow of electricity.

Since law enforcement and military personnel often wear gloves and a multitude of devices that require power, a central power source worn by an operator that feeds power to devices through a wearable component 180 to charge or operate these devices could simplify power management and make devices lighter because fewer batteries are required.

For enhanced security the wearable component 180 can have integrated sensors and electronic components for operator authentication. For example, a glove with operator authentication would only provide the correct unlock key (e.g., through electric, electromagnetic, or electronic means)

when integrated biometric sensors (e.g., fingerprint reader) and/or keyed-in information authenticate the wearer as an authorized operator. A multitude of otherwise "smart" devices could then be implemented without the need for electronic components in these devices. Instead, the electronic components would be integrated into the wearable component 180.

For example, electronic, electric, and electromagnetic components integrated into a glove could authenticate an operator as authorized user when he or she puts the glove on. Thereafter, the glove could sense the device the operator grabs (e.g., a handgun with a specific magnetic grip signature from magnets in the grip) and, based on that information, polarize the electromagnets in the glove to represent the correct unlock key that allows firing the gun.

Application to Firearms

The present invention can protect any device or machinery that requires an operator to hold a grip, handle, stick, or generally hold a hand on a surface of an object (even flat surface) from unauthorized operation. The device component 230 can be chosen to connect with or actuate with various types of safety mechanisms (mechanical, electrical, electromechanical, etc).

The present invention is particularly suited for use in a firearm. The locking mechanism 110 can, for example, be integrated into the grip of a firearm and connected to the firearm's internal safety. In the default position the firearm is locked. The unlocking mechanism can be integrated into the gloves of law enforcement personnel. The firearm safety will only unlock if the grip of the firearm is held by a person wearing a wearable component 180, such as a glove, with the unlock key (correct number of magnets, in appropriate position, with correct polarization). Any attempt operate the firearm without the unlock key will fail.

Figure 5A:
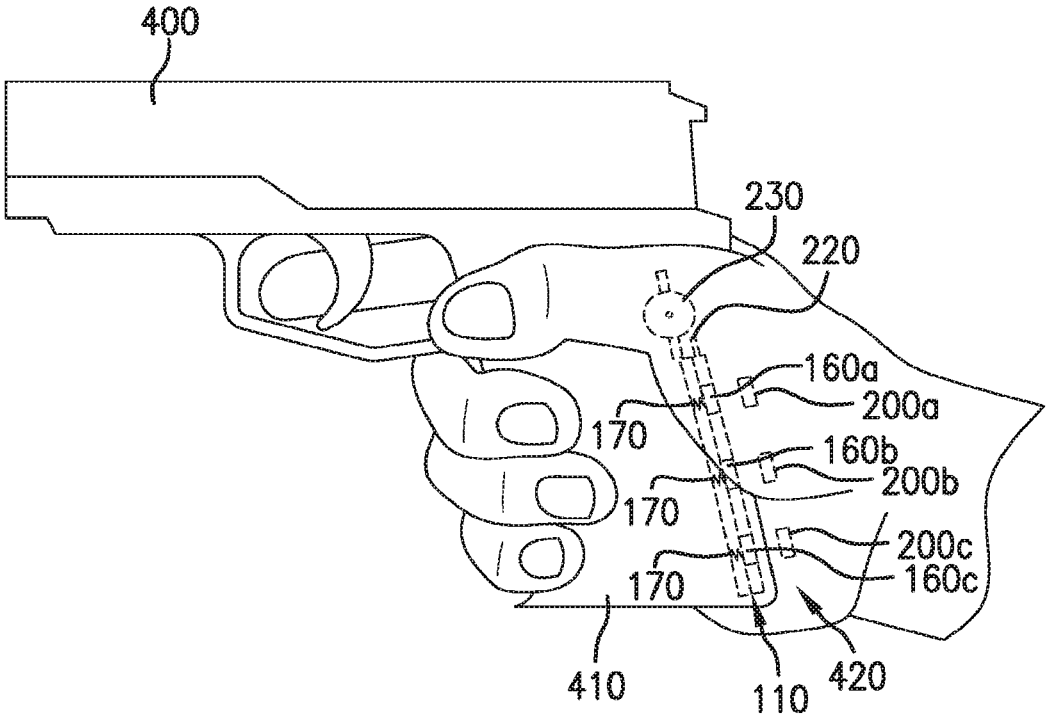
FIG. 5A is a schematic view of a firearm incorporating the locking mechanism of the present invention, in accordance with one embodiment of the present invention.
Figure 5B:
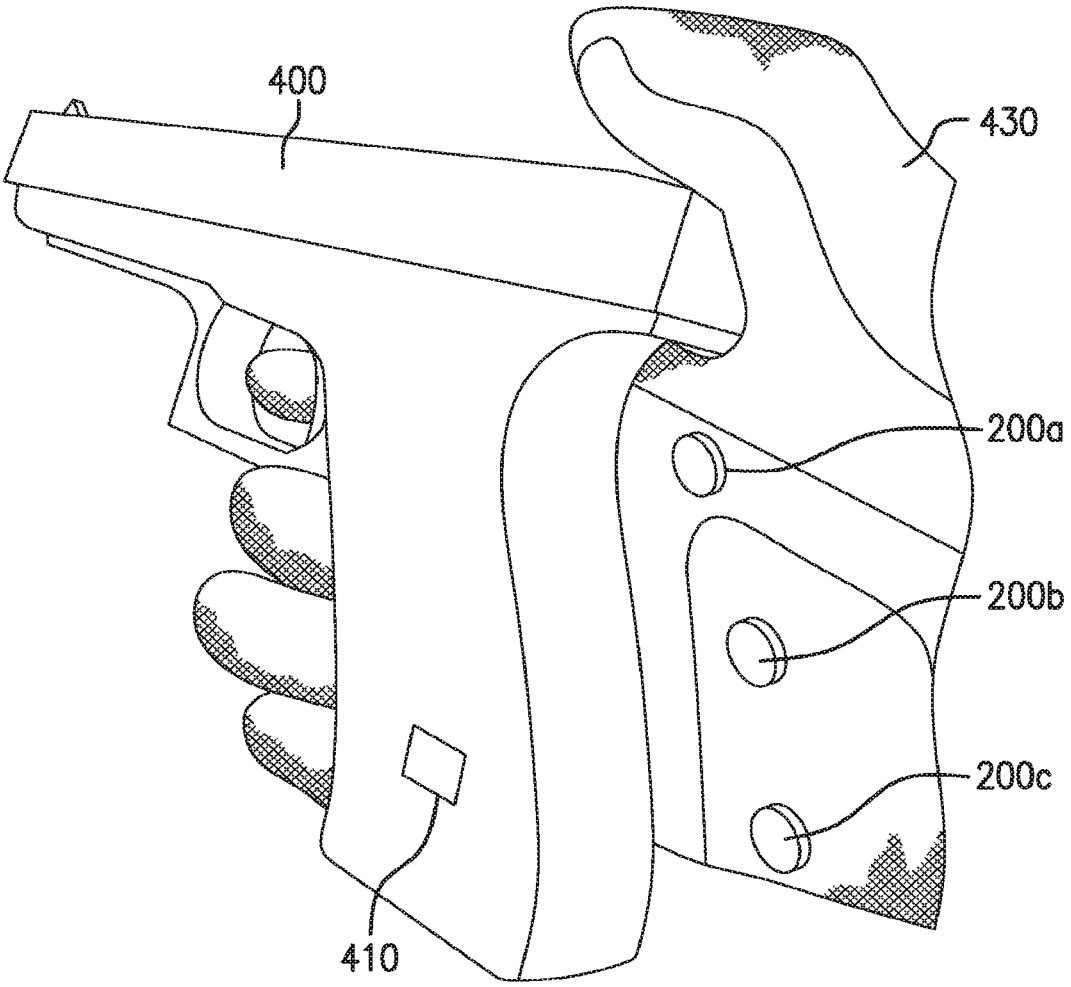
FIGS. 5B and 5C are perspective views of a user holding a firearm that incorporates the locking mechanism of the present invention, in accordance with one embodiment of the present invention.
Figure 5C:
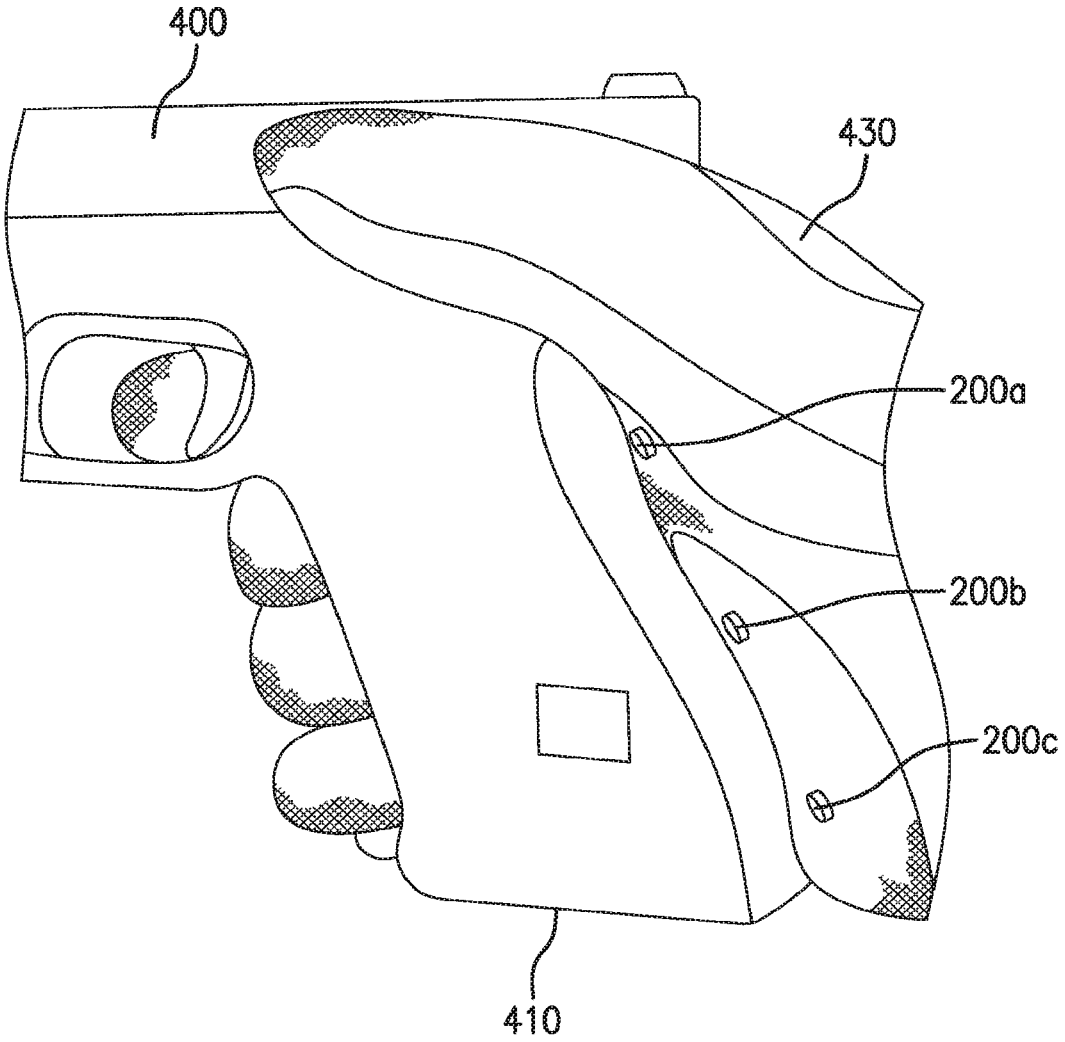

FIGS. 5A-5C illustrate a firearm 400 that incorporates the present invention. The locking mechanism 110 is integrated inside the grip 410 of the firearm 400. Normally the locking mechanism 110 would not be visible from the outside because it is located inside the grip 410, as can be seen in FIGS. 5B and 5C. However, for purposes of illustration the grip 410 is shown in partial cross-section in FIG. 5A so that the position of the locking mechanism 110 inside the grip 410 can be visualized.

The locking mechanism 110 is positioned such that the magnets 160*a*-160*c* face the back 420 of the grip 410. An operator wears a wearable component 180, such as a glove 430, that incorporates magnets 200*a*-200*c* that encode the unlock key in order to operate the firearm 400. The glove 430 is shown in FIGS. 3B and 3C, however only the magnets 200*a*-200*c* are shown in FIG. 3A for purposes of illustration. The glove 430 with the magnets 200*a*-200*c* together make up the unlock mechanism 120.

When an operator wearing the glove 430 holds the firearm 400 and grips the firearm 400 in such a way as to fire the firearm 400, magnets 200*a*-200*c* align with magnets 160*a*-160*c*, as shown in FIGS. 3A and 3C. As discussed above, this causes plate 140 to move to the unlock position, thereby causing integration element 220 to engage device component 230. In the context of a firearm 400, the device component 230 is the firearm's safety mechanism which is placed in the "safety off" position when the plate 140 is in the unlocked position. When the operator puts the firearm 400 down or loosens his or her grip such that the magnets 200*a*-200*c* are no longer aligned with magnets 160*a*-160*c*, or the distance between them is no longer within the unlocking range, then the plate returns to it's default position and the device component 230 returns to the "safety on" position.

In FIGS. 3B and 3C, the magnets 200*a*-200*c* are shown attached to the surface of the glove 430 for purposes of illustration. However, the magnets 200*a*-200*c* could also be positioned in inserts that are located inside the glove 430. As discussed above, rather than using magnets that are attached to the glove 430, magnetic regions could be created at the appropriate positions on the glove 430 by making the glove out of magnetizable material (e.g., magnetizable cloth or magnetizable material interwoven into the glove material) and magnetizing the appropriate regions of the glove 430 so as to encode the unlock key.

The locking mechanism 110 is preferably installed into the grip 410 in such a manner as to be removable by an operator with the right tools. Once removed the key of the locking mechanism 110 may be changed by rearranging the polarization of the magnets 160*a*-160*c*. They unlock key in the wearable component 180 (e.g., glove 430) can be changed accordingly (e.g., by removing the magnets from the inserts in the glove 430 and putting them back with the desired polarity pointing outwards or by magnetizing the appropriate regions if the glove is made of magnetizable material).

The system illustrated in FIGS. 3A-3C utilize 3 magnets in the locking mechanism 110 and 3 magnets in the unlocking mechanism 120. However, any number of magnets can be used depending on the number of possible keys one wants to have available. As discussed above, a system using 3 magnets can encode 8 keys, a system with 4 magnets can encode 16 keys and a system with 5 magnets can encode 32 keys. The number of magnets that can be used is only limited by physical constraints (e.g., size of palm, size of grip, strengths of magnets) and type of application.

Typical firearm implementations may use 3 to 5 magnets, which means a maximum of 32 keys if 5 magnets are used. An unauthorized person taking a locked firearm 400 can eventually find the correct combination to unlock the firearm through trial and error, assuming that the unauthorized person is also in possession of a wearable component 180 with the same number of magnets positioned at the same locations. However, finding the right key through trial and error takes time. One of the benefits of the present invention is that a a firearm 400 incorporating the present invention is not immediately operable by unauthorized personnel. An adversary reaching for the gun of a law enforcement officer or soldier wall not be able to fire the gun immediately. This gives the officer or soldier time to deal with the situation.

Other System Embodiments

A magnetically actuated authentication and unlocking system can be implemented in configurations other than those depicted in systems 100 and 300, while still falling within the scope of the present invention. For example, magnets with rotational alignment can be used. These types of magnets are well known in the art, are preferably produced in matched pairs and exhibit a preference for alignment at any one or many predetermined angles. For example, they may have a preference (felt as a detent) every 90 degrees of rotation. Rotationally aligning magnets can be produced with virtually any angle and number of detents.

Figure 7B:
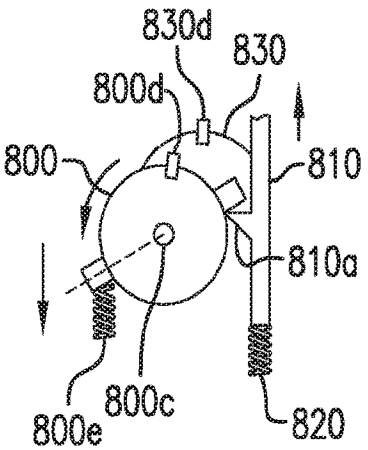
FIGS. 7A-7C are schematic diagrams showing how a mechanism that utilizes the magnetic disk 800 of FIG. 6 operates, in accordance with additional embodiments of the present invention.
Figure 7A:
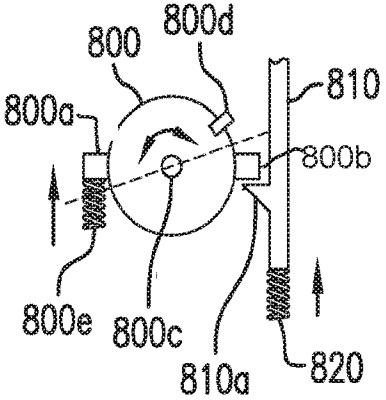
Figure 7C:
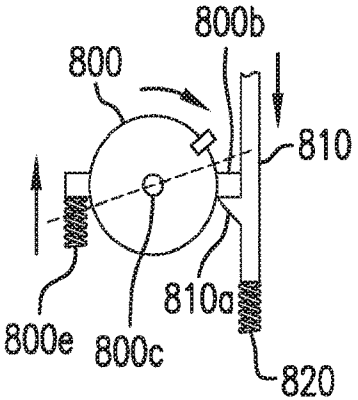
Figure 6:
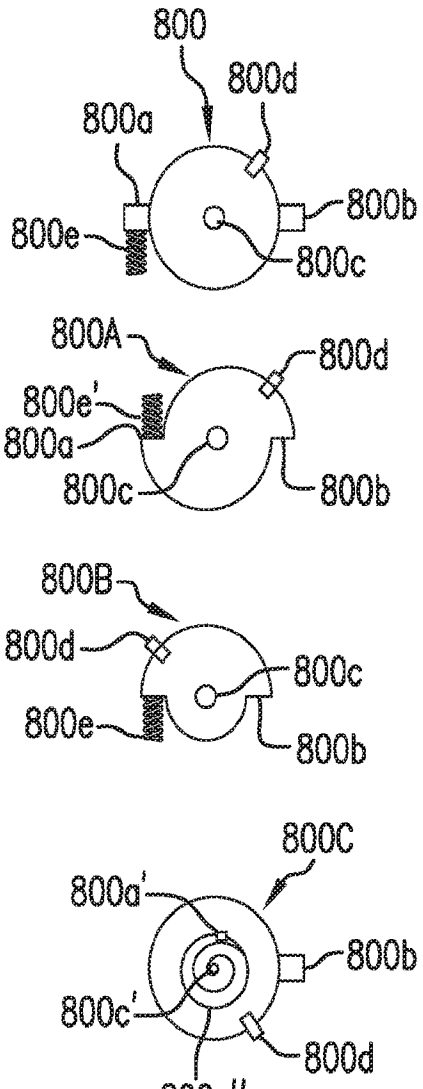
FIG. 6 are schematic diagrams of examples of different possible shapes and configurations of magnets that exhibit rotational alignment, in accordance with one embodiment of the present invention.

FIG. 6 shows examples of different possible shapes and configurations of magnets that exhibit rotational alignment. Magnet disk 800 has a hole 800*c* in the center which allows the disk 800 to be mounted to a plate (not shown) and allows the disk 800 to freely rotate around its center. The disk 800 has two protruding elements 800*a* and 800*b*. Element 800*a* is used to mount compression spring 800*e*. Element 800*b* is used to hold a pin in position (as depicted in FIGS. 7A-7C). Reference number 800*d* shows the magnetic reference point of the disk 800.

Magnetic disk 800A is of a different shape and uses a tension spring 800*e*', but functions otherwise like magnetic disk 800. Magnetic disk 800B functions like magnetic disk 800A, but uses a different shape. Magnetic disk 800C uses a coil spring 800*e*" that is mounted with one end on 800*a*' and with its other end on pin 800*c*' around which the disk 800C rotates.

FIGS. 7A-7C are schematic diagrams showing how a mechanism that utilizes the magnetic disk 800 of FIG. 6 operates. Magnetic disk 800 is mounted to a plate (not shown) in such a way that it can freely move around its center 800*c*. The compression spring 800*e* is mounted to its protruding element 800*a* and to the plate (not shown). The force of spring 800*e* pushes element 800*b* down against the wedge 810*a* on pin 810, keeping the pin 810 in a default locked configuration.

As shown in FIG. 7B, as the matching magnetic disk 830 comes into proximity to magnetic disk 800 (e.g., embedded in a glove of an operator who holds the grip of a gun) its magnetic force turns magnetic disk 800 in such a way that both magnetic disks 800/830 align along their reference points 800*d* and 830*d*. This results in pin 810 being pushed upwards by compression sprig 820. The pin 810 is now in an unlocked configuration.

As shown in FIG. 7C when the matching magnetic disk 830 is removed (e.g., the operator releases the grip and puts the gun back into a holster) spring 800*e* turns the magnetic disk 800 back to its original position. Spring 800*e* much stronger than spring 820 and therefore the mechanism pushes pin 810 down into its default locked configuration.

Figure 8:
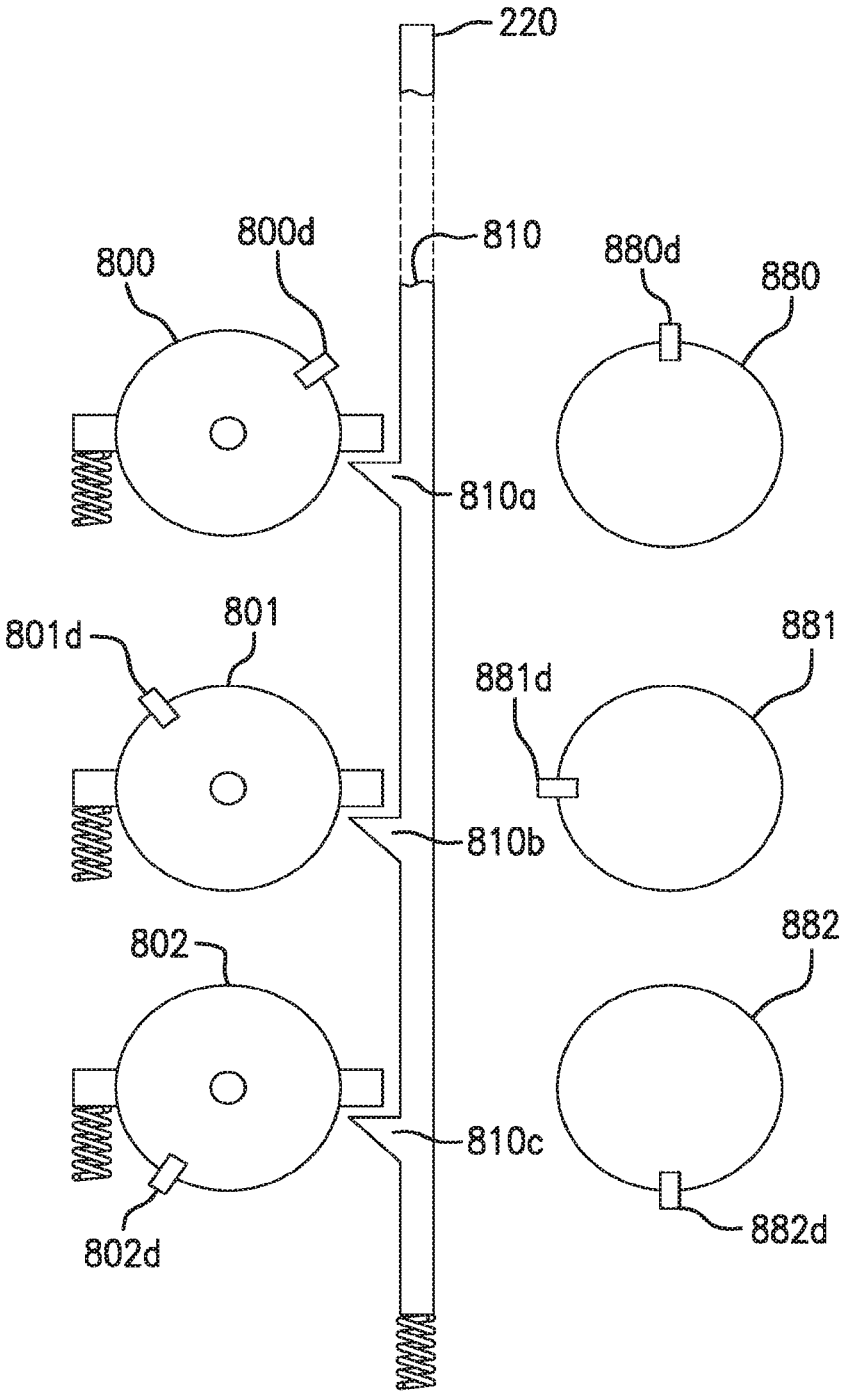
FIG. 8 is a schematic diagram showing a mechanism implemented with three pairs of magnetic disks, in accordance with one embodiment of the present invention.

FIG. 8 is a schematic diagram showing a mechanism implemented with three pairs of magnetic disks. Magnetic disks 800, 801 and 802 each keep pin 810 in its default locked position. Magnetic disks 880, 881 and 882 are preferably fixed-mounted (such that they cannot rotate) in a wearable gear (e.g., a glove) in such a manner that they line up with their matching disks when an operator holds the grip or handle that includes the locking mechanism. For purposes of illustrating how matching magnetic disk pairs line up along their reference points, the disks 880, 881, 882 are depicted and referenced as disks. However, in practice these will have different shapes that allow these disks to be affixed within wearable gear to restrain movement around their center. The disks could have rectangle shapes or round shapes with protruding elements or look like a gear wheel.

In the embodiment of FIG. 8, the reference points on each disk pair (800*d*/880*d*, 801*d*/881*d*, 802*d*/882*d*) are positioned such that once the disk pairs line up and are within magnetic range the disks 800, 801 and 802 will each be forced to move approximately 45 degrees counterclockwise. This will cause pin 810 to move from its default locked position into the unlocked position, pushing the integration element 220 upwards to engage a device specific mechanism that can e.g., put a gun from SAFE mode to FIRE mode. If one of the pairs of magnetic disks has a magnetic signature that does not match (i.e., if they are not matching pairs of magnets) then one of the magnetic disks 800, 801 or 802 will remain in its default position, not allowing pin 810 to move to its unlocked position.

Figure 9:
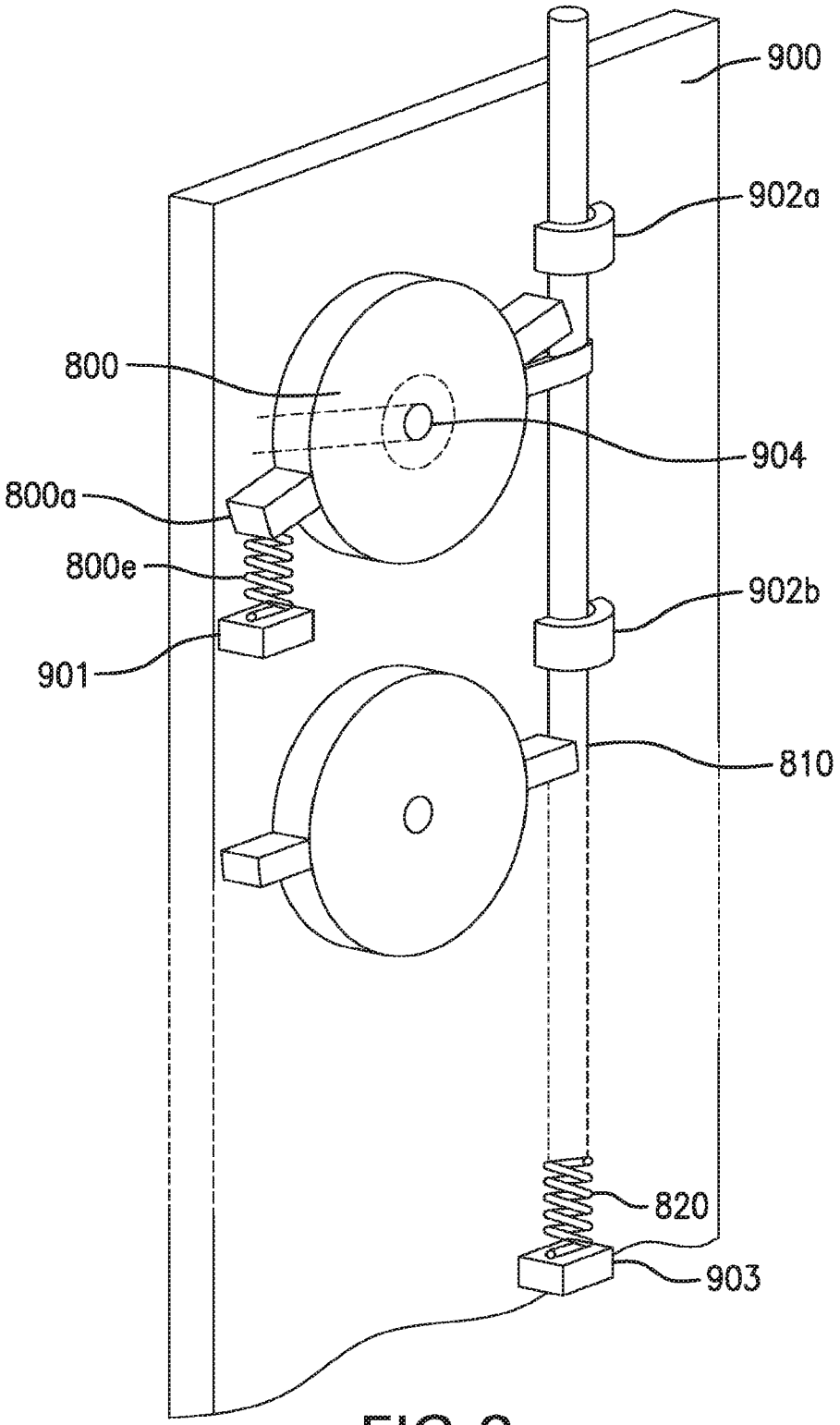
FIG. 9 is a schematic diagram illustrating an example of how pin 810 and the other components shown in FIGS. 7A-8 can be mounted to plate 900, in accordance with one embodiment of the present invention.

FIG. 9 shows an example of how pin 810 and the other components shown in FIGS. 7A-8 can be mounted to plate 900. Magnetic disk 800 is mounted to the plate 900 through pin 901 that allows free rotational movement of the magnetic disk 800 but no other movement. The other magnetic disks are mounted to plate 900 in a similar fashion.

Spring 800*e* is mounted on socket 901, which is affixed to the plate 900 (e.g., glued to the plate, screwed to the plate, etc.) or molded into the plate 900. The other end of spring 800*e* is connected to the protruding element 800*a*. Pin 810 is mounted to the plate in such a way that it can only move the vertical direction. Elements 902*a* and 902*b* (and so forth) mount the pin to the plate 900 and restrict any movement other than vertical movement. Elements 902*a* and 902*b* are suitably clamps. Spring 820 is mounted to socket 903 which is affixed to the plate 900 (e.g., glued to the plate, screwed to the plate, etc.) or molded into the plate 900. Pin 810 can be of any shape that allows for vertical movement of the pin 810.

Other Applications

In law enforcement and military applications, the present invention can be incorporated in a variety devices. These can include personal firearms (as discussed above, e.g., sidearms, shotguns, rifles, sub-machine guns), heavy weapons (machine tazers, grenades, cars (e.g., to open doors or move the transmission lever from park to drive, glove with the correct key has to be used), radios, and other equipment. A law enforcement officer jumping out of his car and chasing a suspect on foot does not have to fear that an unauthorized person can grab the shotgun or rifle from his car and use it against him if the shotgun or rifle incorporates the present invention. Nor can an unauthorized person get into the officer's vehicle and drive away it the vehicle incorporates the present invention.

Another possible application of the present invention is as a cordless kill switch. The locking mechanism 110 of the present invention can be connected to the internal controls of machinery in such a manner that the machinery stops operating immediately or after a certain time the operator releases the grip or removes the hand from a surface. In general, the present invention can be incorporated into any device that requires an operator to hold or manipulate a grip, handle or stick controller. Examples include door handles (e.g., for houses, a safe, cars, etc.), vehicle controls (e.g., the cyclic in helicopters, the throttle of a motorcycle) and any other type of stick controllers.

The foregoing embodiments and advantages are merely exemplary, and are not to be construed as limiting the present invention. The present teaching can be readily applied to other types of apparatuses. The description of the present invention is intended to be illustrate and not to limit the scope of the claims. Many alternatives, modifications, and variations will be apparent to those skilled in the art. Various changes may be made without departing from the spirit and scope of the invention, as defined in the following claims.

What is claimed is:

1. An unlocking and locking system for a device, comprising:

a device component that is actuatable to lock and unlock the device;

a locking mechanism positioned in the device and comprising, a first support structure that comprises an integration element that is adapted to mechanically engage the device component, and at least two magnetized regions that are supported at separate spaced apart locations in the first support structure;

an unlocking mechanism comprising a second support structure comprising a wearable component adapted to be worn by a user, wherein the wearable component comprises a respective magnetized region supported at separate spaced apart locations for each magnetized region in the first support structure;

wherein the magnetized regions in the first and second support structures are adapted such that when the wearable component is within a predetermined distance from the first support structure a magnetic attractive or repulsive force moves the locking mechanism by a sufficient distance to actuate the device component; and wherein when a user holds the device while wearing the wearable component the respective magnetized regions in the wearable component align with the magnetized regions in the first support structure and generate the repulsive or attractive magnetic force that moves the locking mechanism.

2. The system of claim 1, wherein the polarity of the magnetized regions in the first support structure and the polarity of the magnetized regions in the second support structure are configured to generate a repulsive magnetic force when the wearable component is within a predetermined distance from the first support structure.

3. The system of claim 1, wherein the polarity of the magnetized regions in the first support structure and the polarity of the magnetized regions in the second support structure are configured to generate an attractive magnetic force when the wearable component is within a predetermined distance from the first support structure.

4. The system of claim 1, wherein the device comprises a firearm.

5. The system of claim 4, wherein the wearable component comprises a glove.

6. The system of claim 1, further comprising at least one compliant member attached to the first support structure and that maintains the first support structure in a default locked position when the wearable component is not within the predetermined distance needed to move the first support structure.

7. The system of claim 6, wherein the at least one compliant member comprises a spring.

* * * * *